US005690069A

United States Patent [19]

Huwarts

[11] Patent Number: 5,690,069

[45] Date of Patent: Nov. 25, 1997

[54] INTERNAL COMBUSTION ENGINE HAVING ROTARY DISTRIBUTION VALVES

[76] Inventor: Maurice Huwarts, 19, rue Jean Crespon, Nimes 30900, France

[21] Appl. No.: 704,674

[22] PCT Filed: Mar. 23, 1995

[86] PCT No.: PCT/FR95/00362

§ 371 Date: Sep. 18, 1996

§ 102(e) Date: Sep. 18, 1996

[87] PCT Pub. No.: WO95/26460

PCT Pub. Date: Oct. 5, 1995

[30] Foreign Application Priority Data

Mar. 25, 1994 [FR] France ..... 94 03932

[51] Int. Cl.[6] ..... F01L 7/02; F01L 7/16; F01L 7/18

[52] U.S. Cl. ..... 123/490.2; 123/190.12; 123/80 BA; 123/80 C

[58] Field of Search ..... 123/190.1, 190.12, 123/190.2, 80 R, 80 BA, 80 C

[56] References Cited

U.S. PATENT DOCUMENTS

| | | | |
|---|---|---|---|
| 2,730,088 | 1/1956 | Hyde . | |
| 3,203,409 | 8/1965 | Allen | 123/80 BA |
| 3,948,227 | 4/1976 | Guenther | 123/80 BA |
| 3,993,036 | 11/1976 | Tischler . | |
| 4,421,077 | 12/1983 | Ruggeri | 123/80 BA |
| 5,361,739 | 11/1994 | Coates | 123/190.2 |
| 5,448,971 | 9/1995 | Blondell et al. | 123/190.12 |
| 5,572,967 | 11/1996 | Donaldson, Jr. | 123/80 C |

FOREIGN PATENT DOCUMENTS

| | | | |
|---|---|---|---|
| 285539 | 10/1988 | European Pat. Off. | 123/80 R |
| 479778 | 5/1916 | France . | |
| 514480 | 3/1920 | France . | |
| 3515262 | 1/1986 | Germany . | |
| 143345 | 5/1920 | United Kingdom . | |
| WO 93/25802 | 12/1993 | WIPO . | |

*Primary Examiner*—Erick R. Solis
*Attorney, Agent, or Firm*—Greenblum & Bernstein P.L.C.

[57] ABSTRACT

A multi-cylinder internal combustion engine comprising a cylinder assembly with intake ports and exhaust ports arranged in register, wherein the distribution system for opening and closing said intake and exhaust ports include two rotary pipes each consisting of a plurality of mutually communicating aligned hollow valves. The rotary intake pipe and the rotary exhaust pipe are housed in an intake manifold and an exhaust manifold respectively, each defining a chamber surrounding said intake pipe and said exhaust pipe respectively over a large part of the periphery thereof, said chambers being sealed off from one another and arranged so that gaseous fluids can flow freely outside and along said rotary distribution pipes.

12 Claims, 11 Drawing Sheets

INTERNAL COMBUSTION ENGINE HAVING ROTARY DISTRIBUTION VALVES

The present invention relates to an internal combustion engine having rotary distribution valves.

Attempts have already been made to eliminate the drawbacks of the standard valve distribution systems by proposing distribution devices having rotary valves.

For example, the document U.S. Pat. No. 2,730,088 discloses a multi-cylinder internal combustion engine comprising a set of aligned cylinders wherein the combustion chambers each communicate with an intake port and an exhaust port, which intake ports and exhaust ports of this set of cylinders are disposed in alignment, wherein the distribution means which make it possible to open and close said intake and exhaust ports comprise two rotary pipes of circular cross-section, each of which includes a plurality of aligned hollow valves, rigidly connected to one another and communicating with one another, whose lateral wall is provided with a plurality of separate, angularly offset apertures, the number of which corresponds to the number of cylinders to be served, one of which rotary pipes allows the opening and closing of the line of intake ports of the set of cylinders, while the second allows the opening and closing of the line of exhaust ports of this set of cylinders.

Each rotary pipe is constituted by alternating cylindrical portions of different diameters, and the apertures through which the gasses pass are provided in the portions of smaller diameter. Each rotary distribution pipe is housed in a fixed sleeve, and its portions of larger diameter are sized so as to have an appropriately adjusted rotational and sliding clearance within said fixed sleeve, which larger portions are equipped, near their ends, with gaskets which form a seal impermeable to the passage of the gasses.

The device described in the document U.S. Pat. No. 2,730,088 has a substantial drawback which stems from the fact that the gasses circulate exclusively inside the rotary intake and exhaust distribution pipes.

The result, on intake, is that the first cylinder is fed first, then the second, then the third, etc.

These cylinders, therefore, are successively fed in a way that is very uneven, both in terms of volume and in the quality of the gas mixture, so the engine has poor equilibrium.

Likewise, the evacuation of the exhaust gasses only occurs inside the rotary exhaust pipe, for each cylinder in succession, so the exhaust of the gasses also occurs in a very non-uniform way in which the cylinders are more or less distanced from the outlet of said pipe.

Another drawback of the device described in the above-mentioned document resides in the fact that it is necessary to place the carburetor or the exhaust at one end of the rotary tubular distribution pipes, which constitutes a constraint when the engine must fit within a limited volume.

One object of the present invention is to eliminate the above-mentioned drawbacks of multi-cylinder internal combustion engines with rotary distribution systems of the type described above.

According to the invention, this objective is achieved by means of an engine of this type which is particularly remarkable in that the rotary intake pipe and the rotary exhaust pipe are housed in an intake manifold and an exhaust manifold, respectively, each of which manifolds forms a chamber or space which surrounds said intake pipe and said exhaust pipe, respectively, over a large part of their periphery, which chambers are impermeably separated and arranged to allow the gasses to circulate outside and along these rotary pipes.

Due to the above characteristic dispositions, the gasses circulate both through the inside and along the outside of the rotary distribution pipes in the space provided between these pipes and the inner surface of said manifolds, in which the gas stream (fuel and/or oxidant) whirls in such a way that on delivery, all the cylinders are fed under substantially the same conditions, in terms of volume as well as in the quality of the gas mixture, so that better combustion and a better equilibrium of the engine is obtained.

The evacuation of the gasses, which occurs both through the inside and along the outside of the rotary exhaust pipe, is also greatly improved.

Moreover, due to these characteristic dispositions, it is possible to position the carburetor(s), or other delivery devices (injectors, etc.) and the exhaust, at different places on the cylinder head, which constitutes an appreciable advantage when the engines must be housed in limited volumes.

According to another characteristic disposition of the invention, each intake and exhaust port is equipped with at least one movable seat which makes it possible to modify the section through which the fluids pass, as well as the moment or instant at which said port opens or closes, and adjustment means which make it possible to adjust the positions of these movable seats, which means comprise a cylinder impermeably installed through the impermeable wall separating the intake and exhaust manifolds, in which is housed a piston subject to the action of a compression spring which tends to push it in the direction of the exhaust manifold, at least one side of which piston is connected, by means of a joint, to a control rod which is itself linked to a connecting rod attached to a shaft to which other connecting rods are attached, each of which is linked by means of a transmission linkage to at least one of the movable seats of at least one of the rotary valves.

The objects, characteristics and advantages mentioned above, and still others, will become more apparent from the following description and from the appended drawings in which.

Figure 2:
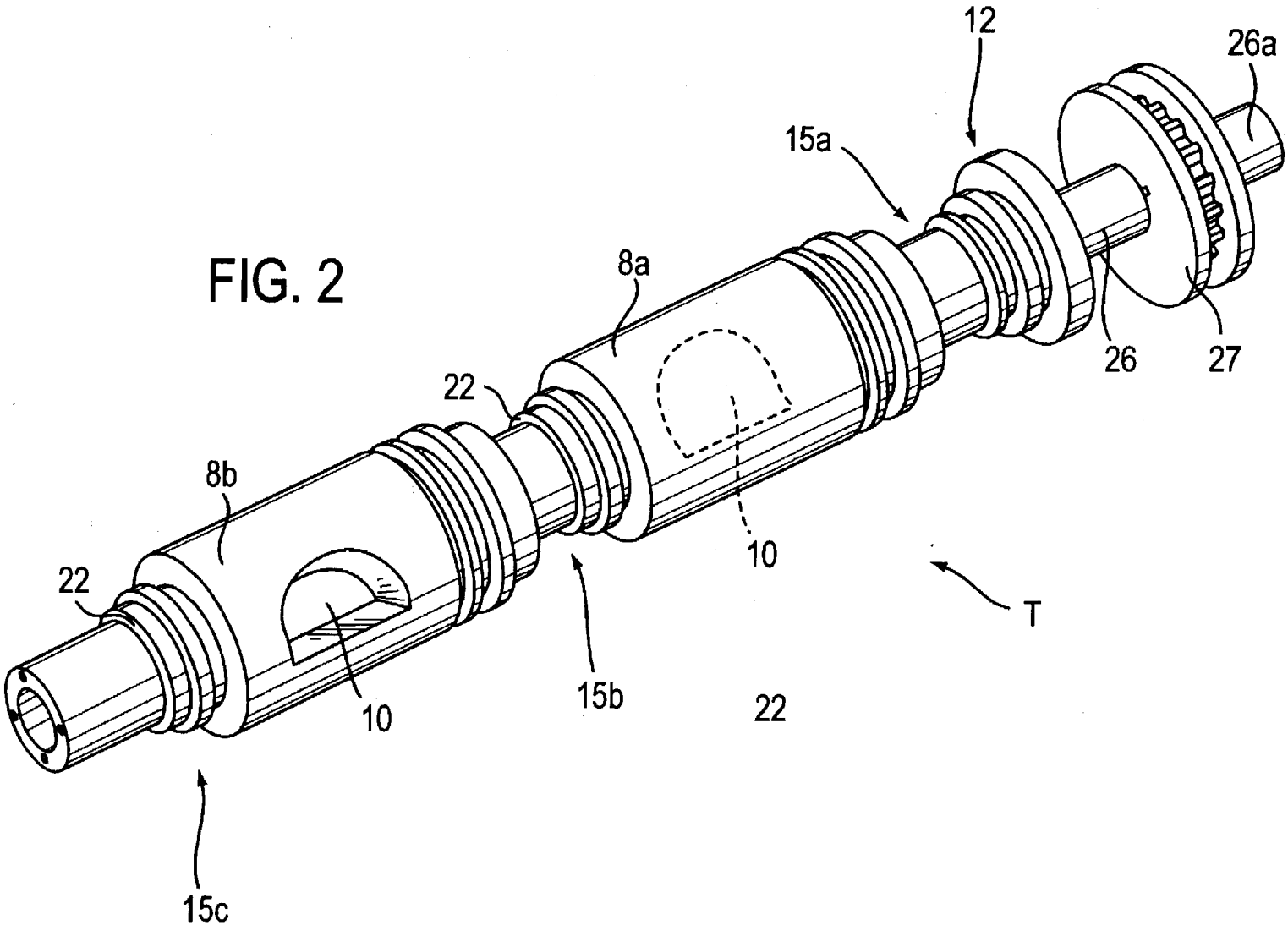
FIG. 2 is a view in perspective of an example of embodiment of a rotary distribution pipe constituted by two valves disposed end to end.
Figure 2A:
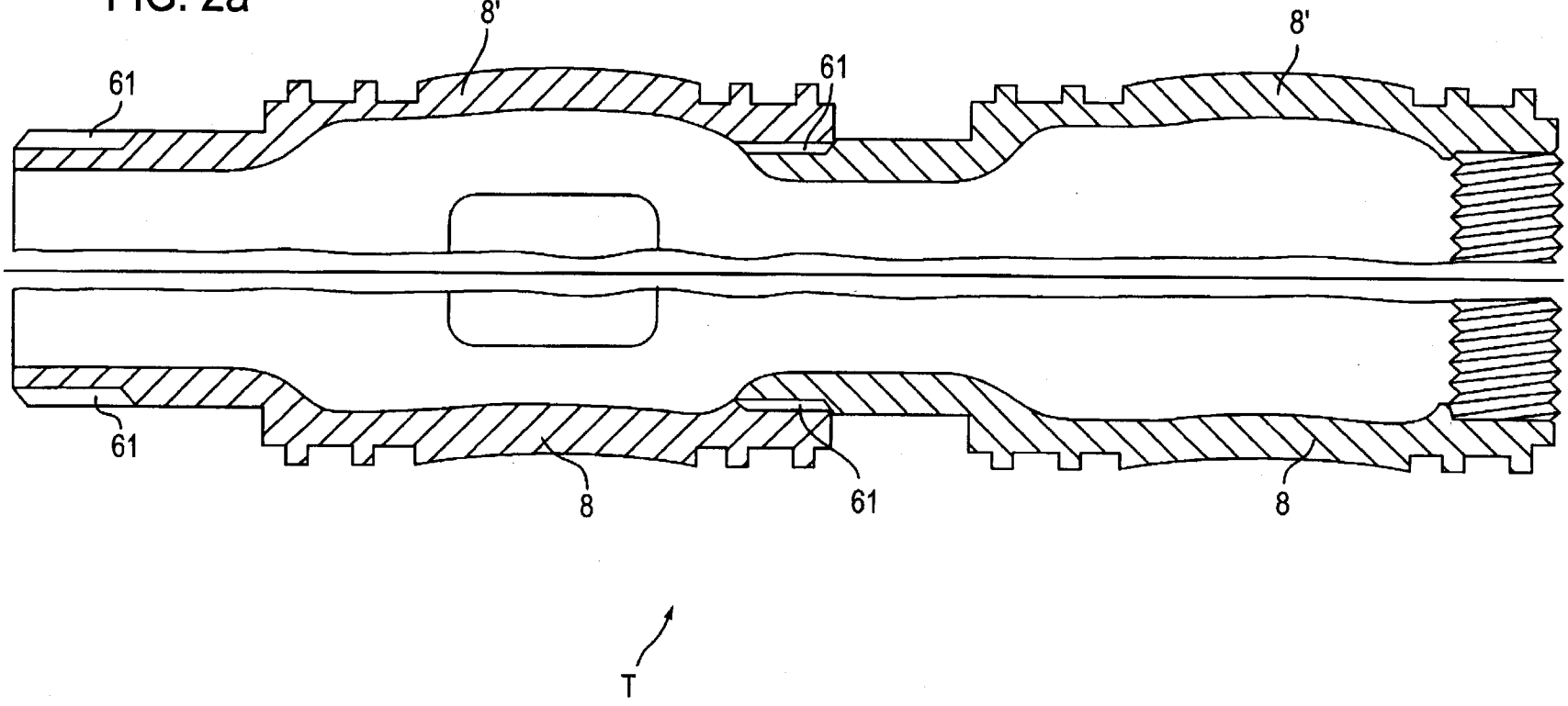

FIG. 2*a* is represents, in two axial half-sections, two other examples of embodiment of a rotary distributing pipe constituted by two valves assembled end to end.

Figure 3:
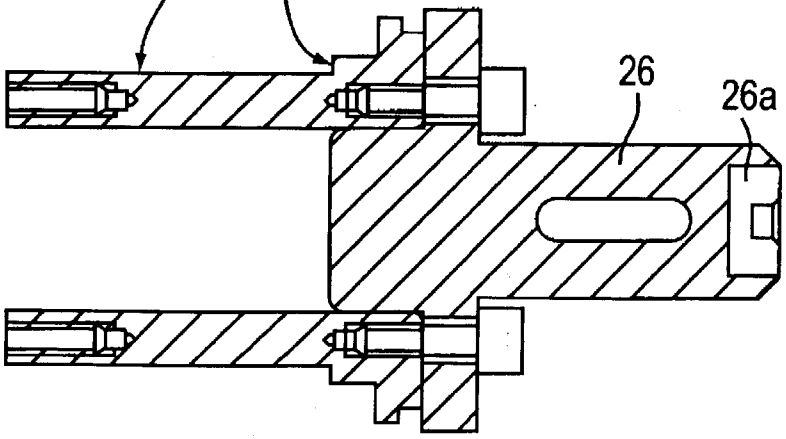

FIG. 3 is an axial cross-sectional view of the driving end piece of a rotary pipe.

Figure 3A:
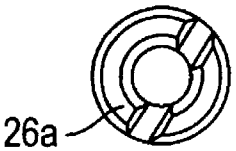

FIG. 3*a* is a front view of the end of this driving end piece.

Figure 4:
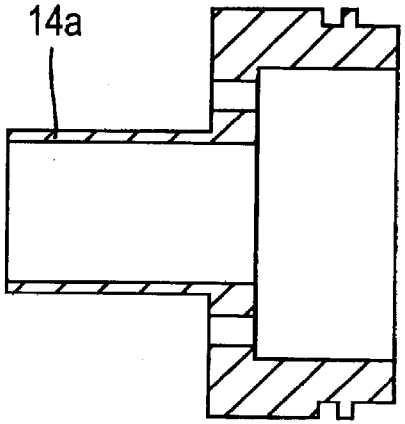

FIG. 4 is an axial cross-sectional view of an embodiment of the opposite end piece of the pipe.

Figure 5:
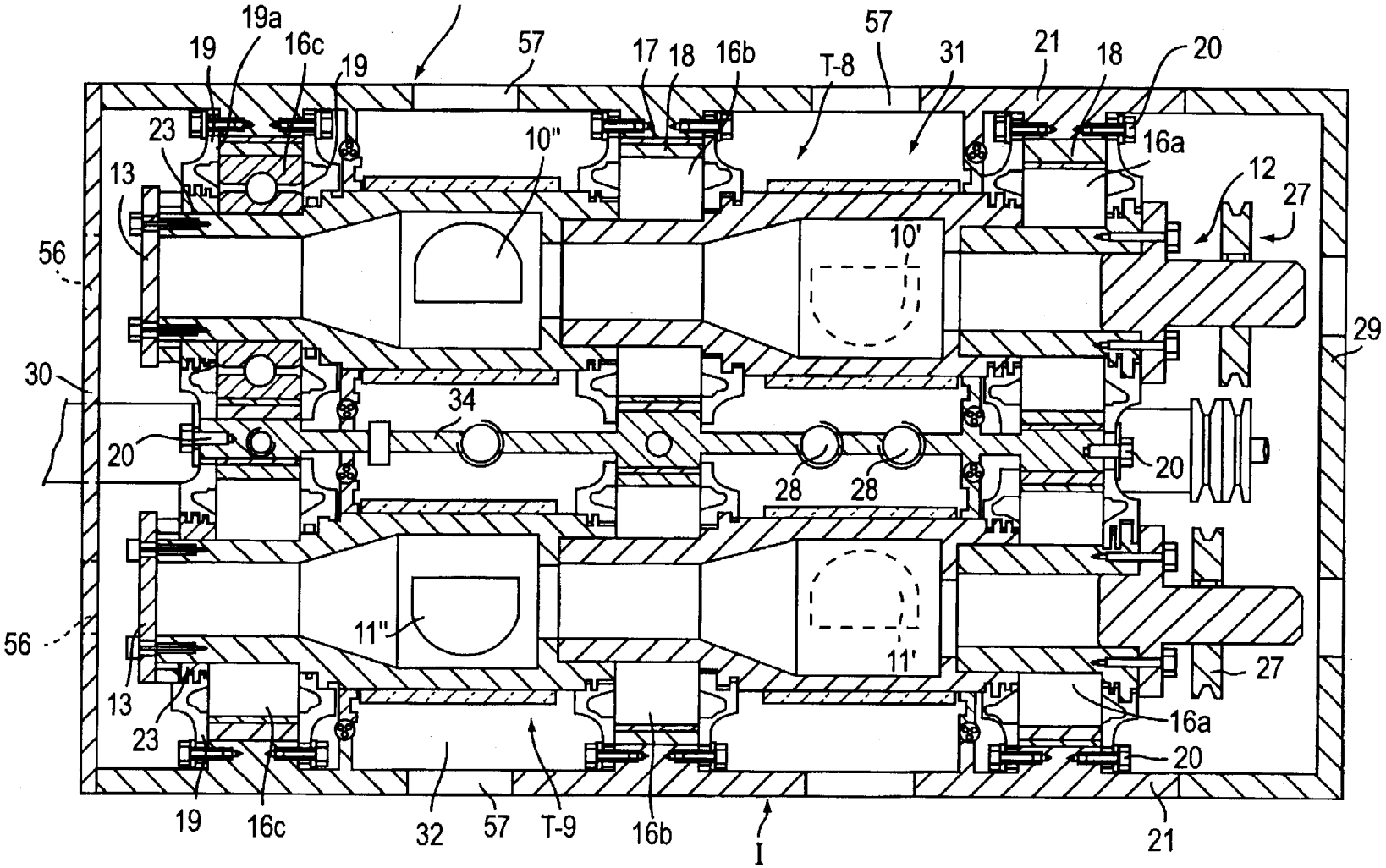

FIG. 5 is a sectional planar view of a distribution assembly according to the invention.

FIGS. 6 through 9*a* illustrate the operation of a distribution system according to the invention.

Figure 10:
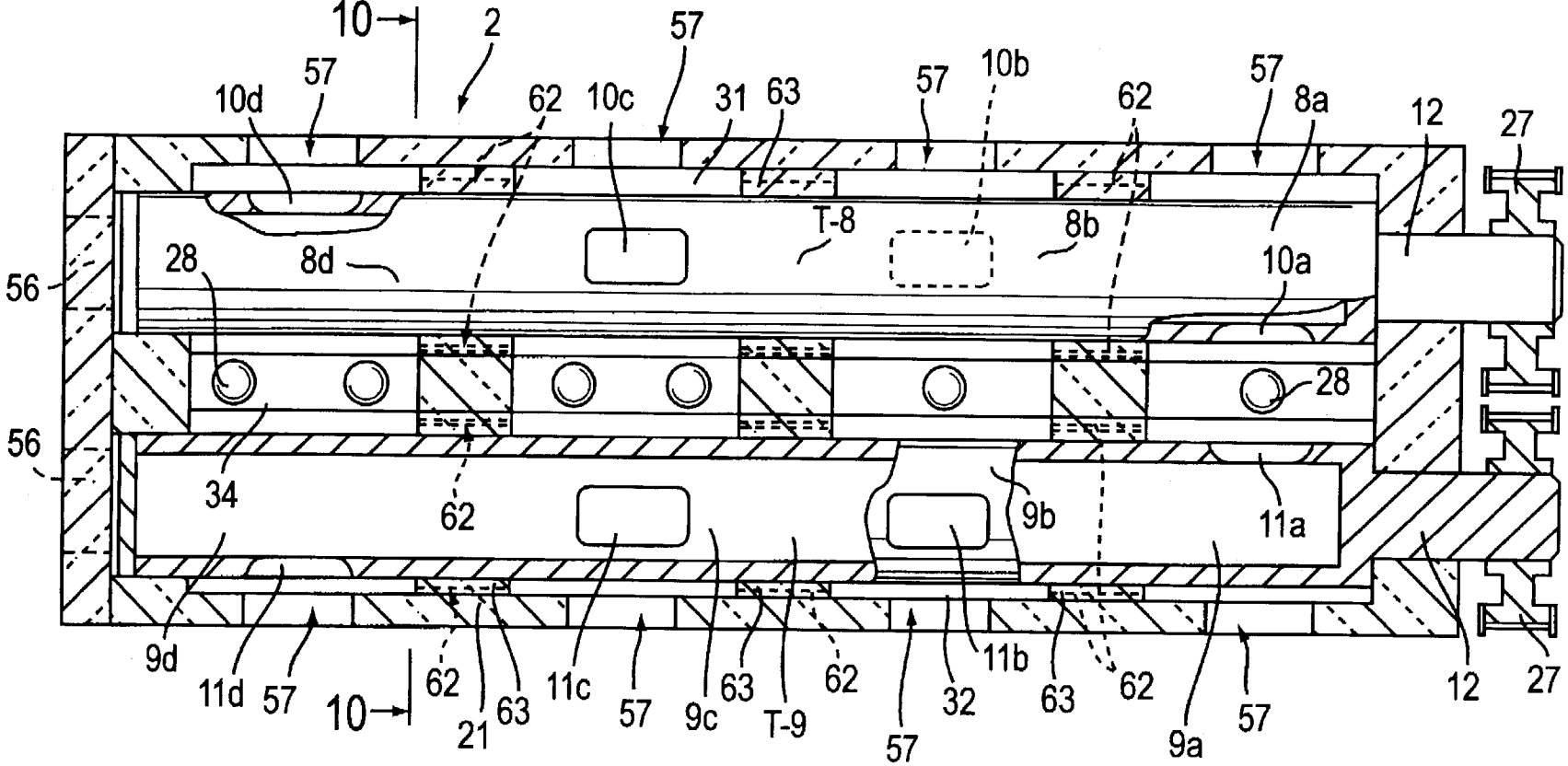

FIG. 10 is a schematic, sectional planar view of an example of embodiment of the rotary intake and exhaust pipes which equip the upper part of a four-cylinder engine.

Figure 10A:
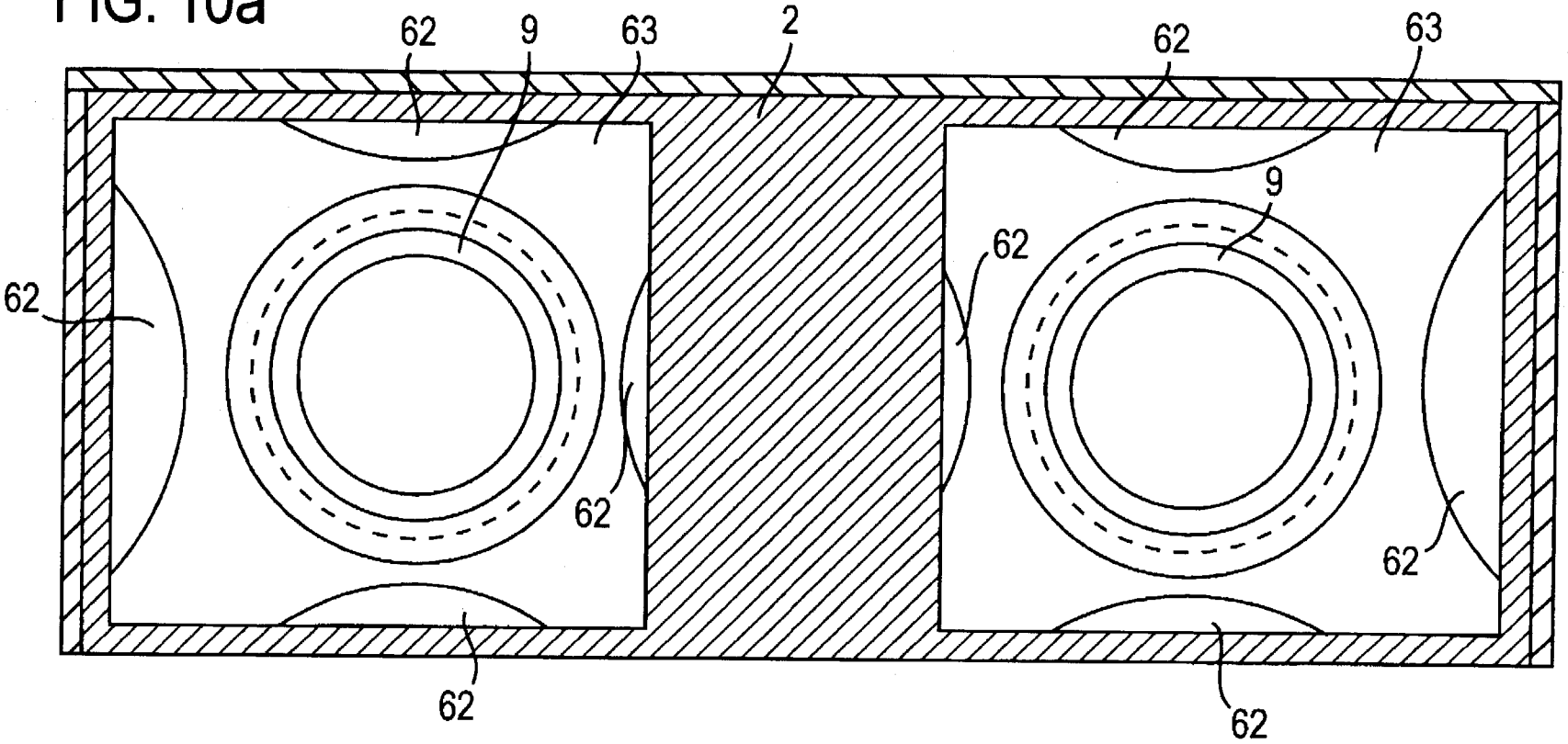

FIG. 10*a* is is a larger-scale, schematic view along the line 10—10 in FIG. 10.

Figure 11:
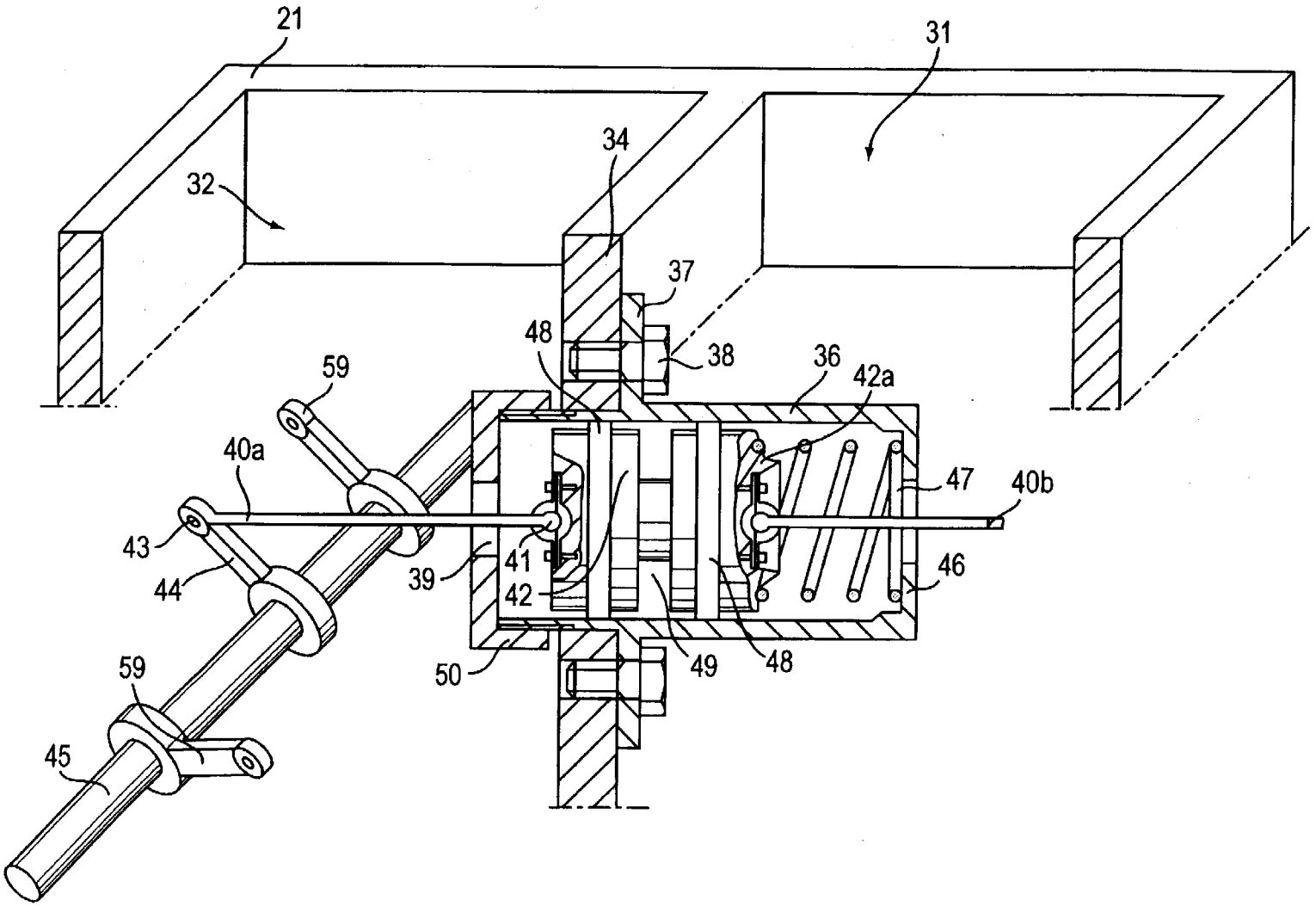

FIG. 11 is a perspective cross-sectional view which illustrates a control device for the system for adjusting the movable seats of the rotary valves.

Figure 12:
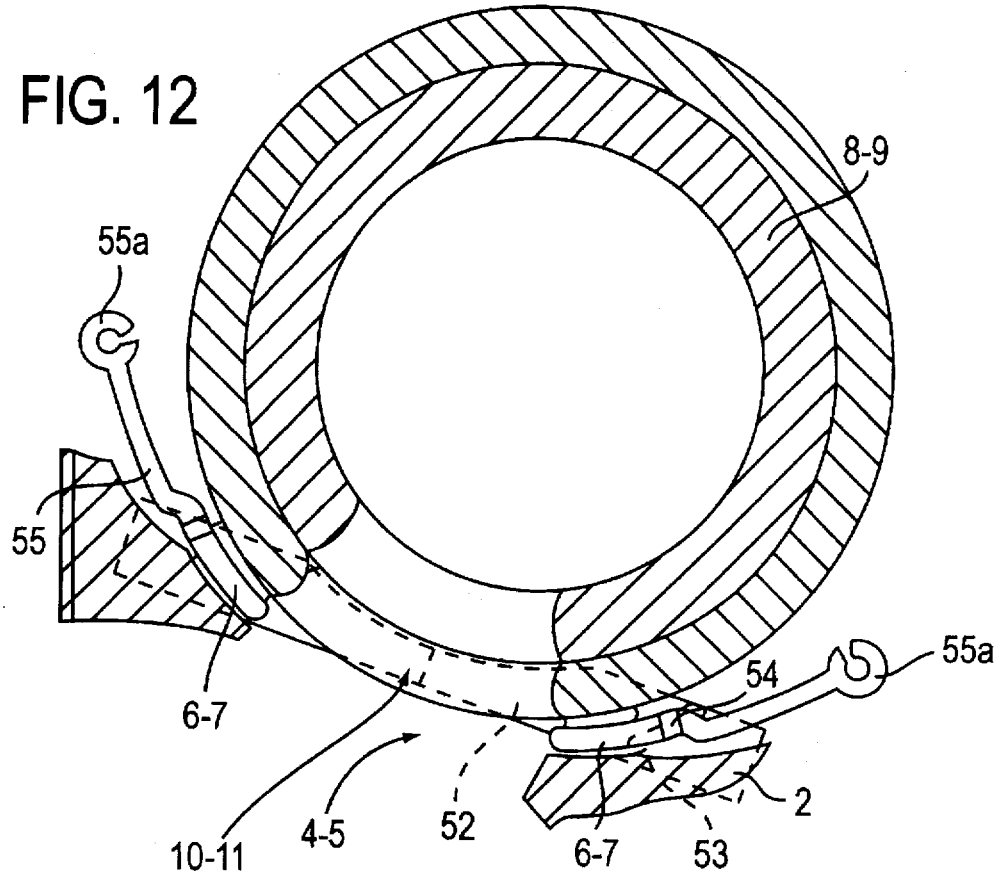

FIG. 12 is a cross-sectional view of a rotary valve and its movable seats.

Figure 13:
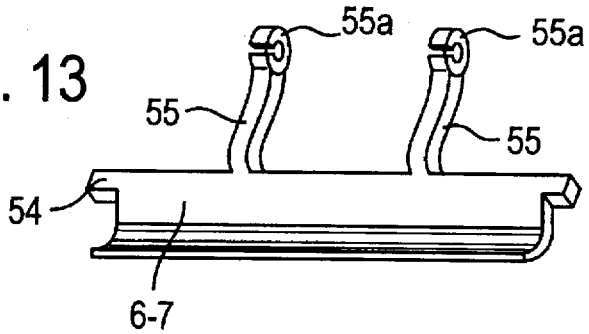

FIG. 13 is a perspective view of one of the movable seats.

Figure 14:
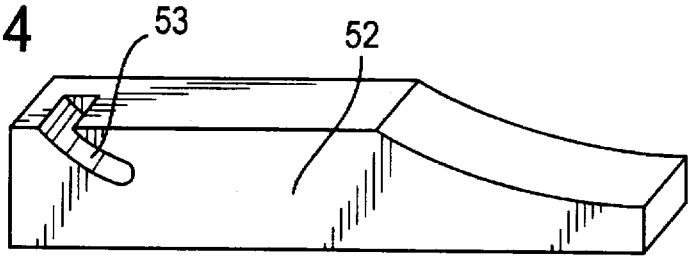

FIG. 14 is a front view of a lateral guide flange for the movable seats.

These drawings will be referred to in order to describe an advantageous, but non-limiting, example of embodiment of the internal combustion engine according to the invention and, more specifically, of the distribution device which equips this engine.

Figure 1:
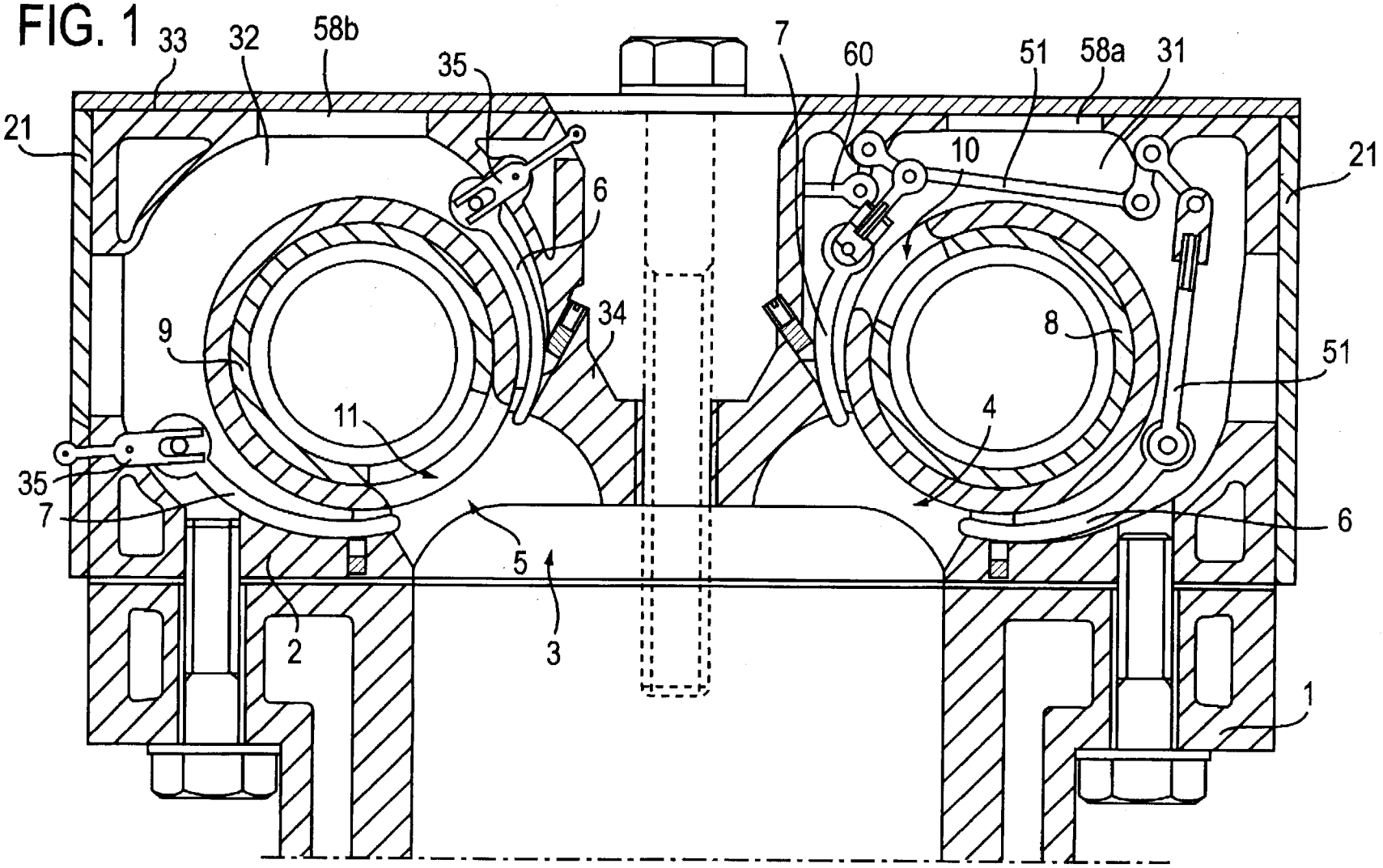
FIG. 1 is a longitudinal cross-sectional view of the upper part of a cylinder equipped with a distribution device according to the invention.

FIG. 1 shows the upper part of a cylinder 1 and a cylinder head 2 attached to the upper part of this cylinder which delimits the combustion or explosion chamber 3. The intake ports 4 and exhaust ports 5, which are respectively equipped with the seats 6, 7 of the valves, are disposed in the head 2, which for example is made of specially designed aluminum and has an appropriate configuration.

The valves are constituted by hollow rotary elements 8, 9 of circular cross-section, in the lateral wall of which is disposed an aperture 10, 11, respectively, for each cylinder of the engine to be served or supplied. These valves can have a cylindrical, conical, oval, or even spherical shape.

Depending on the number of cylinders to be served or supplied, two or more than two rotary valves 8, 9 are assembled in succession and in alignment, for example by screwing or by another method.

FIG. 2 illustrates two cylindrical rotary valves 8*a*, 8*b* assembled end to end and designed to equip a two-cylinder engine. In the disclosure which follows, the assemblies T embodied in this way will be designated "rotary pipes" in order to simplify the description.

FIG. 2*b* is shows two other examples of embodiment of a rotary distribution pipe T constituted by two valves 8 and 8' assembled end to end, which can slide relative to one another within a limited amplitude by means of simple grooves 61, making it possible to avoid any problems resulting from the effects of an expansion or a slight misalignment. Moreover, in this figure, the valves 8 in the lower partial cross-section have a concave configuration, while the valves 8' in the upper partial cross-section have a shape which bulges in their center part, a shape which increases the capacity for introducing fresh gasses into the cylinders.

As previously indicated, the number of valves 8 or 9 which constitute each intake pipe T-8 and each exhaust pipe T-9 depends on the number of cylinders in the engine. Thus, FIG. 10 shows rotary intake pipes T-8 and exhaust pipes T-9 which are each constituted by an alignment of four valves 8*a*, 8*b*, 8*c*, 8*d* or 9*a*, 9*b*, 9*c*, 9*d*, respectively, the apertures 10*a*, 10*b*, 10*c*, 10*d* or 11*a*, 11*b*, 11*c*, 11*d* of which are offset by 90 degrees.

The valves 8*a*, 8*b*, 8*c*, 8*d*, etc. which are aligned in this way and are affixed to one another in rotation, constitute a tubular assembly in which the valves are in permanent communication through their bore.

The idea is that the rotary pipes T-8 and T-9 can be fitted and sized to serve or supply a variable number of cylinders whose axes may or may not be parallel.

Each pipe T is constituted, for example, by machined tubular steel parts wherein the external surfaces, and internal surfaces if necessary, can be provided, along all or part of their length, with a coating of ceramic or another material which can resist thermal and other shocks during the combustion, expansion and exhaust phases, particularly in the case of an internal combustion engine.

One end of the pipes T-8 and T-9 is equipped with a driving and guiding end piece designated in its entirety by the reference numeral 12 (FIG. 3), while the opposite end of this pipe can be provided with a closing end piece 13 (FIG. 5) which can be constituted by a simple plate impermeably screw-mounted on this end, or by an end piece 14 comprising a tubular axial extension 14*a* (FIG. 4) which allows it to be connected, if necessary, for example by means of a rotary joint, to a carbureted mixture intake pipe or an exhaust pipe.

According to the embodiment in FIGS. 2 and 5, each rotary pipe T-8 and T-9 embodied and equipped in this way includes, separate from its portions equipped with the apertures 10 or 11, parts of reduced diameter 15*a*, 15*b*, 15*c* (FIG. 2) to which are attached the inner races of bearings 16*a*, 16*b*, 16*c* which guide these pipes in rotation and position them in translation. The outer races of these bearings are attached to the walls of housings provided in the head 2, which will be described later in the present disclosure. The above-mentioned bearings could be replaced by rings.

Each bearing 16*a*, 16*b*, 16*c* or external friction ring is surrounded by two concentric or eccentric rings 17, 18, at least one of which can be driven in rotation, but with only a limited potential for angular movement. This bearing and ring assembly is held in place and guided, at the level of the bearing blocks, between two pairs of half-shells 19. One of the half-shells in each pair of half-shells 19 is equipped with a lug 19*a*. These lugs 19*a* penetrate into one side of each of the two eccentric rings in such a way as to produce a displacing motion which tends to separate the rotary tube T-8, T-9 from the seats 6, 7 (which are described in greater detail later in the present disclosure), or to bring them back together, by means of a simple rotation of the half-shells, which are attached to the head in such a way as to have a plurality of angular positions.

This results in an ease of adjustment; the bolts 20 which attach these half-shells to the bearings are directly accessible after the removal of the elements 29 and 30 which seal the apertures in the head which are not used for the intake or outflow of fluids.

The axial positioning of the rotary pipes T-8, T-9 in their bearings 16*a*, 16*b*, 16*c* is ensured by a machined shoulder 22 against which one of the lateral sides of the bearing cage comes to a stop, the other side of which is stopped by the end of the next rotating cage, or by a fixed collar 23 in the case of the last bearing 16*c*. In the case of the front bearing 16*a*, the role of this collar is fulfilled by a shoulder 24 oriented toward the inside belonging to the end piece 12. This end piece 12 includes a smooth supporting surface 25 on which the inner race of the bearing 16*a* is mounted, and a shaft 26 on which a notched pulley 27 driven by a notched belt or a sprocket is attached, for example by cottering.

The external end 26*a* of this steel end piece can be machined or molded (FIG. 3*b* is) so that it can drive an ignition device, for example of the Delco (registered trademark) type, or another device necessary to the operation of the engine.

Since any engine would have two rotary pipes T-8 and T-9, it is possible to consider driving one or two ignition devices which, through a different circuit, serve and supply two spark plugs 28 per cylinder, as is clear from in FIGS. 1 and 5. These spark plugs 28 can be installed vertically or at a certain angle within the axial plane of the head, in two reserved passages in the head which open into the combustion chamber.

It is emphasized that in the case of a diesel engine, the second perforation provided in the head and ending in the combustion chamber can be used to house a glow plug or another type of plug.

It is also noted that the end pieces 12 can be coupled to the device for driving the injection pumps of diesel engines or can be used for other functions such as, for example, the control of a direct injection device.

Access to the end pieces 12 and 13 of the pipes is extremely easy after the removal of the front plate 29 or rear plate 30 of the head 2.

Lubrication of the bearings which guide the rotary pipes is carried out by the lubrication system fed by the oil pump of the engine located in the crankcase. The oil, supplied through a conduit which opens into the bearings held in place by the half-shells 19 which hold the concentric rings and the outer cages of the bearings in place, fulfills its function and returns to the crankcase through another free conduit of ample dimensions.

Each rotary pipe T-8 and T-9 driven by the notched pulley 27 and notched belt or by a sprocket or chain, the movement of which originates from the rotation of the crankshaft of a four-stroke engine, makes one revolution for every two turns of this crankshaft.

Each valve element of each of the pipes T-8 and T-9 has a hole or aperture 10 or 11, respectively, which is carefully gauged and sized and which, during the rotation of the pipe, periodically communicates with one of the ports 4 or 5 opening into the combustion chamber of one of the cylinders, and depending on the assigned function of the pipe, this port is closed by the cylindrical wall of the valve between two passes of the aperture.

On the other hand, when the aperture 10 or 11 has left the position in which it communicates with the port 4 or 5 accessing the combustion chamber 3, it opens into the cavity 31 or 32 surrounding the rotary pipe T-8 or T-9, respectively.

The intake pipes T-8 and exhaust pipes T-9 are placed inside two adjacent cavities with a cylindrical or other shape, provided in the head 2 and impermeably separated from one another, which cavities respectively constitute the intake manifold 31 and the exhaust manifold 32.

These intake manifolds 31 and exhaust manifolds 32 are constituted by longitudinal chambers or spaces which surround the rotary intake pipe T-8 and exhaust pipe T-9, respectively, along the largest part of their periphery, which longitudinal chambers or spaces allow the circulation of gasses along the outside of these distribution pipes. Thus it is understood that the gasses can circulate freely both inside and outside the pipes. In order to allow the free circulation of the gasses along the outside of the rotary distribution pipes, the cages 63 which ensure the positioning of the assemblies 16-17-18 constituting the bearings of these pipes, and more particularly the cages which contain the intermediate bearings between cylinders, are not impermeable, but are perforated or provided with passages 62 which allow this free circulation (FIGS. 10 and 10A).

The apertures 10, 11 in each pair of twin valves 8, 9 of the rotary distribution pipes T-8, T-9 have positions which are angularly offset relative to one other, allowing them to fulfill the function devolved to them, namely "Intake" and "Exhaust," respectively.

During the rotation of the crankshaft, the rotary pipes T-8 and T-9 are driven in rotation at a speed which is half the speed of the crankshaft, as indicated previously, so that each of them executes a half-turn while the crankshaft makes a full turn.

The rear area of the cylinder head, after the removal of its rear plate 30 and its penetration by perforation or displacement, and after the removal of the plates 13 which seal the ends of the rotary pipes T-8, T-9, can be used for replacing these plates 13 with end pieces 14 of the type illustrated in FIG. 4 comprising a sleeve 14*a* which is long enough to pass through holes 56 reserved in the rear plate 30 and to open outside of this plate (indicated by broken lines in FIG. 5), which will then receive an impermeable vertical separating partition (not shown), disposed as an extension of the partition 34 between the cavities 31 and 32 which contain the rotary pipes T-8 and T-9, respectively, in the area outside the rear bearings 16*c*.

In this case it is possible, without seeking impermeability between the added end pieces 14 and the rear part 30 of the head, to use the latter to receive pipes for feeding the engine cylinders and/or for evacuating the exhaust gasses.

preferably, however, the intake and exhaust pipes which communicate with the intake manifold 31 and the exhaust manifold 32 are connected to the lateral walls 21 of the head or heads 2 or to the lids 33 covering the head or heads, which can have ports 58*a*, 58*b*, respectively, connecting them to pipes for delivering fresh gasses or evacuating exhaust gasses (not shown). This lid or lids on the top, which meet on the axis of the impermeable center partition 34 separating the rotary pipes T-8 and T-9 are fixed to this partition on one side and bolted to the head or heads on the other sides, allowing the heads of the fastening bolts and the ports for spark plugs, injectors and the like to remain free.

It is noted that for any conduit which conveys a fluid and opens at any point into a cavity constituting an intake manifold 31 or an exhaust manifold 32, and which is provided in the head 2 around one of the rotating pipes T-8 or T-9, the transfer of this fluid is greatly facilitated by the fact that it can pass from one cavity to the other through the inside of a pipe which in this case fulfills the function of a conduit.

By considering the application of the invention to a two-cylinder engine and by referring to the example illustrated in FIG. 5, it is possible to understand the basic role of the internal passage of the pipes.

While the apertures 10', 11' of the valves 8*a*, 9*a* of the pipes T-8, T-9 which serve the cylinder I are in the lower position, the apertures 10", 11" which serve the cylinder II are in the upper position, 180° from the former and in free communication with the surrounding cavity, and whether the intake or exhaust ports provided in the head or heads are lateral (57) or vertical (58*a*, 58*b*) or disposed at the rear (56) of the pipes, T-8 or T-9, the free circulation of the fluids around and through the inside of these pipes facilitates their rapid flow.

Moreover, the great possibilities offered relative to the disposition of the fluid intakes and outlets must be noted. It is possible, in the case of a four-cylinder engine, to have just one or multiple intake and/or outlet points, since all the lateral or top surfaces, with the exception of the locations for positioning the front, rear and intermediate bearings between cylinders, can be penetrated and used for the intake or evacuation of fluids.

On the other hand, the intake system and the exhaust system are impermeably separated by the center partition 34, as indicated previously.

FIGS. 6–6*a*, 7–7*a*, 8–8*a*, 9–9*a* are associated pairs of schematic views illustrating the four-stroke cycle of an internal combustion engine equipped with the distribution device according to the invention, in a single cylinder of this engine.

Figure 6A:
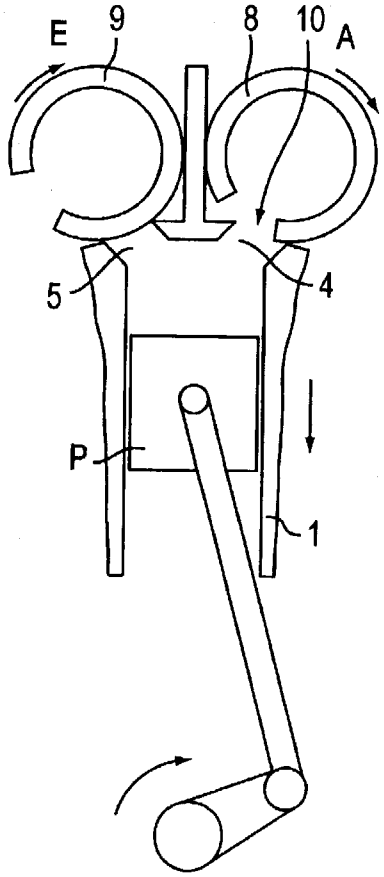
Figure 6:
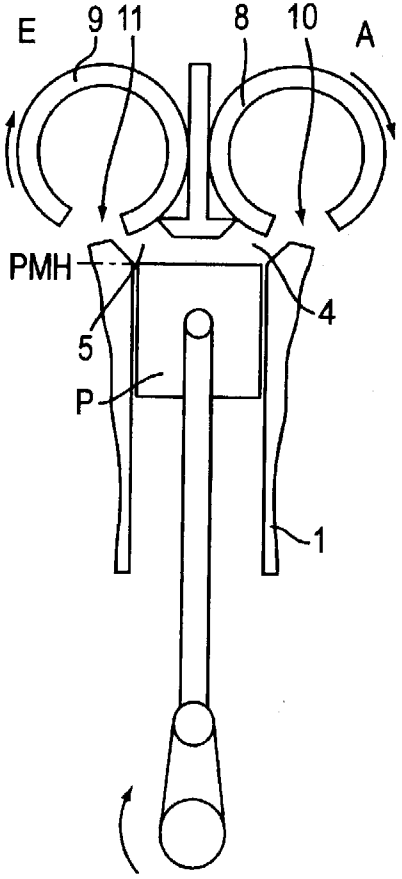

First stroke: intake (FIGS. 6 and 6*a*)

In FIG. 6, the piston P is at PMH (top dead center) at the end of its upstroke, which terminates a four-stroke cycle. The aperture 11 of the rotary exhaust valve 9 is still in communication with the cylinder 1, while the aperture 10 of the intake valve 8 enters into communication with this cylinder. In FIG. 6*a*, the piston P lowers, and the rotary exhaust valve 9 closes the exhaust port 5, while the rotary intake valve 8 communicates, through its lateral aperture 10, with the cylinder 1 into which the carbureted mixture is aspirated.

Figure 7A:
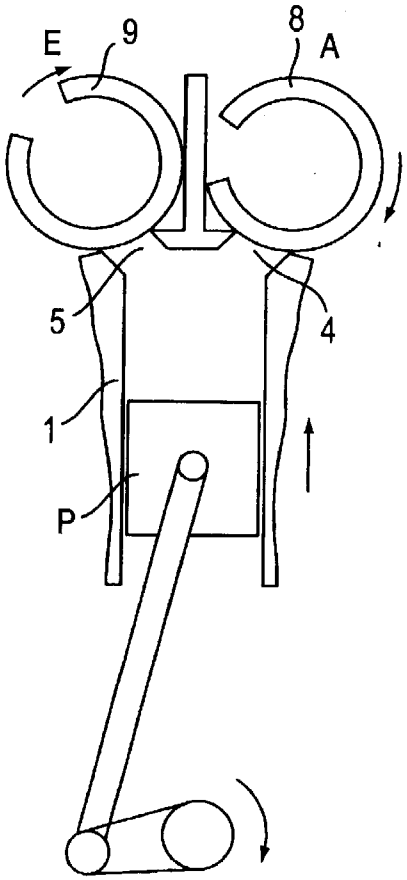
Figure 7:
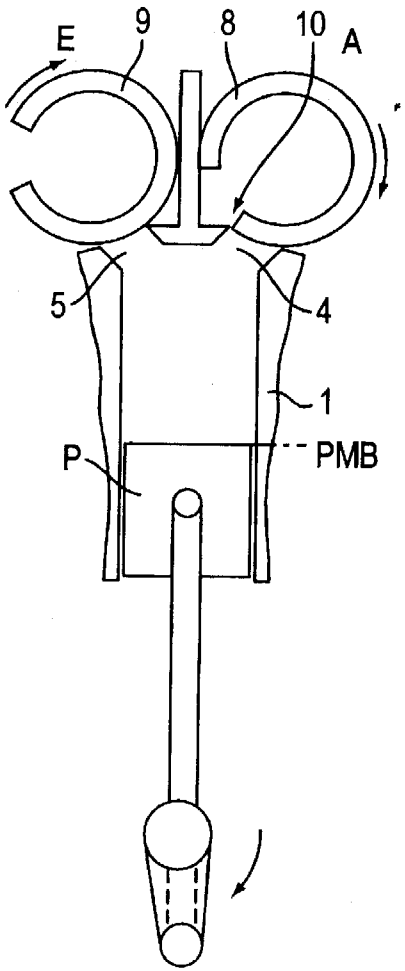

Second stroke: compression (FIGS. 7 and 7*a*)

In FIG. 7, the piston P is at PMB (bottom dead center), and the exhaust port 5 is completely closed by the rotary exhaust valve 9, while the aperture 10 of the rotary intake valve 8 is still in communication with the cylinder 1, through a passage of smaller section. In FIG. 7*a*, which shows the piston 1 during its upstroke, the exhaust ports 5 and intake ports 4 are hermetically sealed by the rotary exhaust valves 9 and the intake valves 8, respectively; the gasses are compressed in the upper part of the cylinder.

Figure 8A:
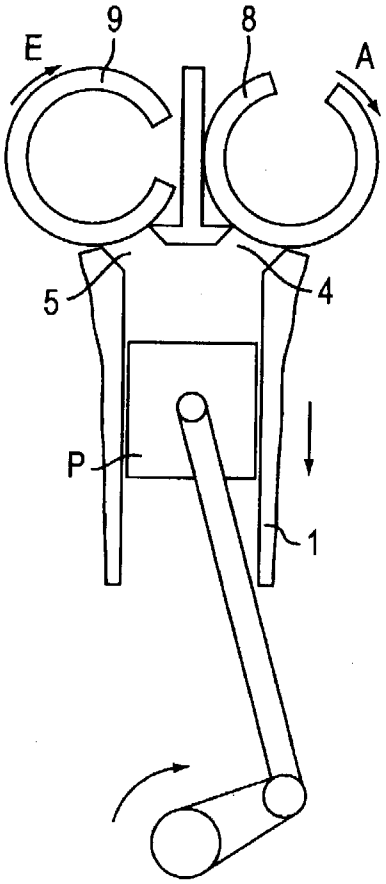
Figure 8:
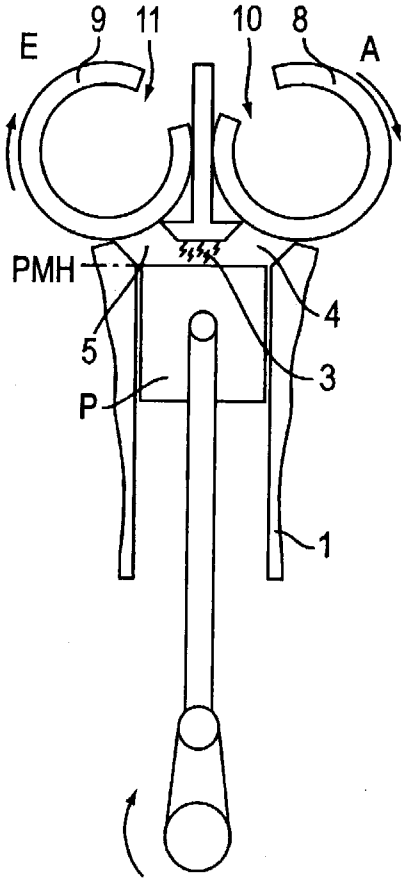

Third stroke: combustion and expansion (FIGS. 8 and 8*a*)

In FIG. 8, the piston P is again at PMH, and the exhaust ports 5 and intake ports 4 are still sealed by the exhaust valves 9 and intake valves 8, respectively. The ignition of the compressed mixture which occurs before the piston P reaches PMH results in the explosion which propels the piston P to the bottom (FIG. 8*a*).

Figure 9A:
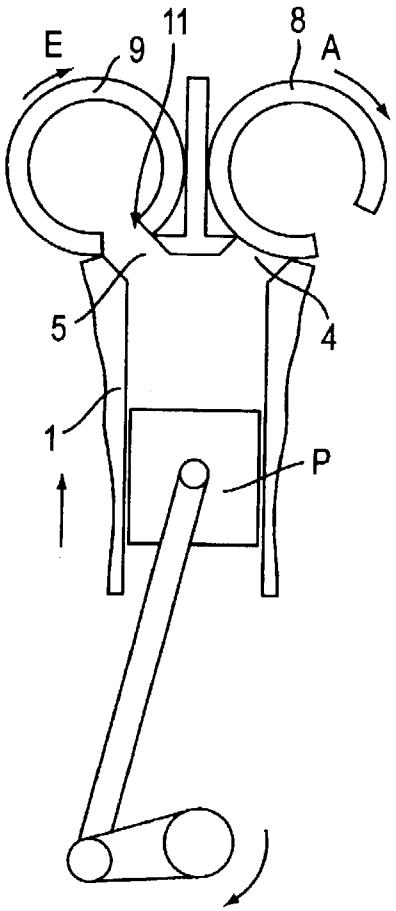
Figure 9:
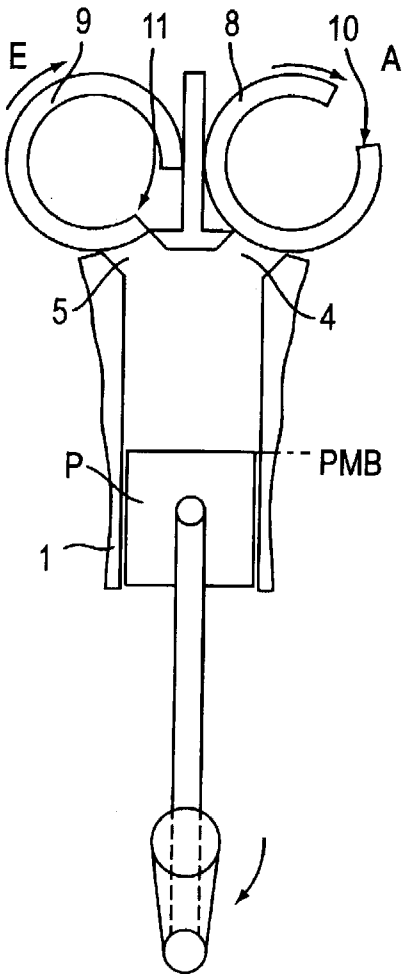

Fourth stroke: exhaust (FIGS. 9 and 9*a*)

In FIG. 9, the piston P is again at PMB, the aperture 11 of the rotary exhaust valve enters into communication with the exhaust port 5 of the cylinder 1, and the exhaust gasses begin to flow toward the outside. In FIG. 9*a*, the piston is on its upstroke, the aperture 11 is in communication with the exhaust port 5, and the exhaust gasses remaining in the cylinder are expelled by the piston.

When the piston reaches PMH (FIG. 6), the cycle ends.

It is noted that when the piston p of a cylinder 1 has passed PMB at the end of its expansion stroke and has begun its upstroke (FIG. 9*a*), the rotary exhaust valve 9 assigned to this cylinder is in the open position and remains so until the piston has passed PMH (FIG. 6), and is then only closed (delayed closure of the exhaust valve) by the rotational movement transmitted to it by means of the notched pulley or the sprocket which drives it (FIG. 6*a*). At the same time, the aperture 10 of the rotary intake valve 8 enters into communication with the intake port 4 (advanced opening of the rotary intake valve) and remains so until the moment at which the piston P, continuing its intake stroke (FIG. 7), has again passed PMB (delayed closure of the rotary intake valve) and begun its compression stroke (FIG. 7*a*).

On the other hand, during the expansion phase and before the piston 1 has reached PMB, the aperture 11 of the rotary exhaust valve 9 enters into contact with the exhaust port 5, allowing the flow of exhaust gasses toward the outside as a result of their expansion (advanced opening of the exhaust valve).

According to another characteristic disposition of the invention, each intake port 4 and exhaust port 5 is equipped with at least one movable seat 6 or 7 which makes it possible to adjust the section through which the fluids pass and, preferably, two movable seats which can be brought together to reduce this section or separated from one another in order to enlarge it. The adjustment of the distribution device described above is obtained by means of a system for adjusting the position of the seats 6 and 7 of the rotary valves 8 and 9, respectively, making it possible to modify the flow time of the fluids by reducing or enlarging the section of the opening which accesses the intake ports 4 and exhaust ports 5. It is noted that the adjustment of the position of the seats 6 and 7 also makes it possible to adjust the moment or instant of the closing and/or opening of the intake and exhaust ports.

FIG. 1 illustrates two embodiments of the assemblies for driving this adjustment device.

The left side of the figure shows a first embodiment, according to which the movable seats 7 are connected to control levers 35 which can be operated remotely, from outside the head.

The right side of the figure shows an adjustment device in which all the functions for modifying the position of the movable seats are contained and operated from inside the head, in the existing volume between this head and the rotary pipe T-8 or T-9 which constitutes the intake manifold 31 or the exhaust manifold 32.

The control which makes it possible to modify the position of the movable seats during operation can be obtained by means of the adjustment device described below and shown in FIG. 11.

This device, which has a very simple design, is composed of a cylinder 36 of machined metal which is installed through the impermeable transverse wall 34 separating the intake manifold 31 and the exhaust manifold 32. The cylinder 36 includes, in its intermediate part for example, a collar 37 provided with holes which allow it to be fastened to this wall by means of bolts 38. In order to reduce the influence of heat on the device, the part of the cylinder installed in the exhaust manifold 32 is preferably as small as possible.

The bottom of the cylinder, on the "Exhaust" side, is closed by means of a cap 50 which is removably fastened to the end of the cylinder, for example by screwing, which cap includes a hole 39 which allows the passage and clearance of a control rod 40*a* connected:

by one of its ends by means of a joint, for example a ball joint 41, to a piston 42 seated so that it can slide in this cylinder, and by its second end by means of a simple pin 43 to a connecting rod 44 rigidly fixed to a shaft 45.

In case of utilization with a turbo compressor, the hole 39 through which the rod 40a passes would be equipped with an 0-ring, since in that case the vacuum effect would be eliminated.

The opposite end of the cylinder includes an internal shoulder 46 against which is lodged one end of a compression spring 47, the other end of which rests against the piston 42, the function of which spring is to push this piston in the direction of the exhaust manifold 32, when the pressures or vacuums decrease or cease.

The characteristics of this spring (diameter, wire diameter, pitch and number of coils, length, material) are determined as a function of the desired utilization and the environment in which it must operate.

The compression of this spring can be modified by the simple addition of one or more adjusting washers placed at the end of the cylinder against the shoulder 46. On the other hand, the end of the spring oriented toward the inside of the cylinder 36 is housed in a groove created in the top of the piston, which also has a guide piece 42*a* of reduced diameter, oriented in the direction of the shoulder 46, which resists any potential buckling of the spring.

The cap 50 makes it possible to prevent any excessive displacement of the piston 42 under the action of the spring 47. It also protects the piston from heat, while its center hole 39 allows both the clearance of the rod 40*a* and the passage of the gasses acting on the end of the piston.

Moreover, the piston is equipped, for example near each of its ends, with a sealing ring 48 made of nitrite-hardened iron or another material.

It is noted that there is no need for absolute impermeability and that an allowance for expansion between the cylinder 36 and the piston 42 must be provided from the start, in order to allow for the effects of heat, particularly on the "Exhaust" side, during prolonged operation.

preferably, the piston 42 also includes a peripheral recess 49 provided between the grooves of the sealing rings 48, which recess is intended to be lined with a T.H.T. lubricant during assembly or possibly later, by means of a lubricator (not shown) which opens into the cylinder 36.

The side of the piston 42 oriented in the direction of the intake manifold 31 is preferably also connected by means of a joint, for example by means of a ball joint, to a rod **40*b*, comparable to the rod 40a, which is itself connected to a connecting rod-shaft-connecting rod assembly similar to that described above. The rods 40*a* and 40*b*** can have an adjustable length and can be embodied in any known way so as to have this characteristic.

As previously indicated, in the assemblies in which one of the end portions of the piston 42-cylinder 36 assembly will be exposed to extreme heat, the major part of this assembly will be positioned on the "Intake" side, where the temperature conditions are different and extremely lower.

It is understood that in an internal combustion engine, the vacuum created at one point during the "Intake" phase, combined with the pressure created when the gasses are evacuated during the "Exhaust" phase, which act on the opposite sides of the piston 42, cause a translational motion of this piston which, due to the two movable rods **40*a*, 40*b* connected to the piston by means of joints, and to a connecting rod 44 attached to the shaft 45, causes a slight rotational motion of this shaft. Also fixed to the shaft 45 are transmission rods 59 connected to the assemblies for controlling the movable seats 6 and 7 of the rotary valves 8 and 9 of the distribution pipes T-8, T-9. The idea is that as many rods 59 as necessary can be attached at different places on the shaft 45**, as desired.

It is noted that the rods 44 and/or 59 can be of different lengths and can be placed, as necessary, in varying positions on the shaft 45, depending on the desired amplitude of the motion to be transmitted by them, it being understood that, if necessary, it is possible:

- to increase the capacity of the cylinder 36-piston 42 assembly by enlarging its diameter;
- to lengthen the principal connecting rod or rods linked to the shaft or shafts to be served;
- to increase the number of cylinder 36-piston 42 assemblies or to combine the assemblies described above.

The shaft 45 is linked by means of the rods 59 to the movable seats 6 and 7 of the valves 8 and 9, respectively, and by a rod 60 to transmission linkages 51 which act directly on these valves, one embodiment of which is shown on the right side of FIG. 1.

All of the movable seats 6 or 7 placed in the part of the head 2 provided with a fluid intake port 4 or evacuation port 5, which number four to a cylinder, come to be seated in a place machined directly into the head. These seats 6, 7 have a shape which curves inward, as shown in FIGS. 1, 12 and 13, in particular.

The shape of this machining serves to create a uniform space between the rotary pipe T-8 or T-9 and the movable seats, respectively 6 or 7, no matter what its position. The displacement of the seats, under the action of the connecting rods which control their movement, between the cylinder block and the rotary pipe to which they are assigned, is also perfectly controlled.

Each end of a movable seat is limited in its lateral displacement by a lateral flange 52 which also serves to improve the seal between the movable seat 6 or 7 and the rotary pipe T-8 or T-9. In addition, the lateral flanges 52 include, on their inner surface, a curved groove 53 in which a lug 54 is engaged, which laterally contains the movable seat 6 or 7 and makes it possible to limit the displacement of this seat.

It is noted that the reinforced ceramic layer of the pipes T-8 and T-9 only grazes an infimal part of the movable seats 6 or 7 whose length, width and thickness are determined as a function of the diameter of the cylinder served.

Since the seats 6 or 7 are subject to thermal and other shocks and to chemical attacks, they are also treated so as to be resistant to these harmful actions, preferably with ceramics reinforced with appropriate mixtures, or with high-strength steels alloyed with special products.

The seats 6 or 7, with inward curving shapes as previously indicated, are extended, opposite their free edge, by separate rods 55, which also curve inward and are disposed at equal distances from the lateral edges of these seats, which rods include a head **55*a* by which they are connected, by means of a joint, to the linkage 51 (right side of FIG. 1) or to the control levers 35 (left side of FIG. 1), depending on the control option used to obtain the displacement of the movable seat elements 6 or 7**.

The invention provides a great improvement over the traditional valve distribution systems, since it allows for the suppression of these systems and all of their springs or other return systems, making it possible to provide a substantial increase in the rotation speed and the efficiency of engines.

The great simplicity and efficiency of the rotary distribution system results from the provision, preferably in the cylinder head 2, of two cylindrical cavities which are sealed off from one another but common to all of the cylinders to be served.

One of these cavities, which forms the common manifold 31 for the intake of the air, which may or may not be carbureted or gasified, required for proper functioning of the engine, contains the rotary assembly T-8 and its seats 6, 7, which may or may not be movable, which replace the intake valves and all the devices for operating them.

This cavity, due to its shape and its volume, which is substantially greater than that required for proper operation of the complete rotary assembly and its seats as well as of all the elements which influence the modification of the position of these seats, ensures the free transfer of gasses from any point to any other point inside this cavity, around the rotary assembly and among the attached elements which enable and facilitate the flow of gasses toward the cylinders, which are also supplied from within the rotary assembly.

It can be perforated, as necessary, in multiple places and connected at one or more points with the external intakes for air or gaseous mixtures required for proper functioning of the engine.

The other cavity, which forms a common manifold 32 for the evacuation of exhaust gasses, contains the rotary assembly T-9 and its seats 6, 7, which may or may not be movable, which replace the exhaust valves and all the devices for operating them.

This cavity 32, whose shape and volume can be completely different from those of the cavity 31, must easily contain the rotary assembly, the seats whether movable or not, as well as all the elements which influence the modification of the position of these seats; it ensures the free transfer of exhaust gasses from any point to any other point inside this cavity, around the rotary assembly and among the attached elements which enable and facilitate the flow of exhaust gasses from the cylinders to the outside, substantially improving their evacuation, which also occurs through the inside the rotary assembly.

It can also be penetrated, as necessary, in multiple places and connected at one or more points to one or more gas evacuation pipes.

When applied to air-cooled engines, the use of the invention does not require any substantial modifications.

However, the external parts of the head or heads in this case can be equipped with ribs of suitable sizes and shapes for evacuating excess calories and assuring proper cooling of the head or heads of this type of engine.

In case of a utilization of the engine at low temperatures, even at negative temperatures, no matter what type of cooling system is used, it is noted that the preheating of the fluids on intake is ensured, as soon as the engine is started, by the heat supply transmitted by the center partition from the exhaust zone to the intake zone, which keeps the latter from icing up.

This center partition also serves, in the other direction, to transfer substantial negative calories, thus allowing cooling of the exhaust gasses.

These supplies of calories or negative calories can be increased, as necessary, either by providing judiciously placed ribs, by reducing the thickness of this partition, or by partially replacing it with a replacement part made of a metal having a higher heat conductivity coefficient.

I claim:

1. A multi-cylinder internal combustion engine comprising at least one set of cylinders (1) whose combustion chambers (3) are each provided with an intake port (4) and an exhaust port (5), which intake ports (4) and exhaust ports (5) of said set of cylinders (1) are disposed in alignment, the distribution means which allow for the opening and closure of said intake ports (4) and exhaust ports (5) comprising two rotary pipes (T-8, T-9) of circular cross-section, each of which is formed by a plurality of hollow valves (S*a*, 8*b*) aligned end to end and in communication with one another, so as to allow the free circulation of the gaseous fluids inside and from one end to the other of the rotary pipes (T-8, T-9) whose lateral wall is provided with a plurality of apertures (10*a*, 10*b*, 10*c*, 10*d*; 11*a*, 11*b*, 11*c*, 11*d*), the number of which corresponds to the number of cylinders to be served or supplied, one (T-8) of which rotary pipes allows the opening and closure of the aligned intake ports (4) of the set of cylinders (1), while the second (T-9) allows the opening and closure of the aligned exhaust ports (5) of said set of cylinders, characterized in that the rotary intake pipe (T-8) and the rotary exhaust pipe (T-9) are housed in an intake manifold (31) and an exhaust manifold (32), respectively, each of which delimits a space or chamber which surrounds said intake pipe (T-8) and said exhaust pipe (T-9), respectively, which chambers (31, 32) are impermeably separated and disposed so as to allow the free circulation of gaseous fluids outside and along said rotary distribution pipes (T-8, T-9), from one end to the other of said intake manifold (31) and exhaust manifold (32).

2. A multi-cylinder internal combustion engine according to claim 1, characterized in that the intake manifolds (31) and exhaust manifolds (32) are constituted by cavities disposed in the cylinder head (2) of said engine.

3. A multi-cylinder internal combustion engine according to claim 1, characterized in that the rotary intake valves (T-8) and exhaust valves (T-9) are rotatably mounted in bearings or rings (16*a*, 16*b*, 16*c*), and the cages (63) supporting these bearings or rings are provided with passages or apertures (62) which allow the free circulation of gasses from one end of the intake manifolds (31) and exhaust manifolds (32) to the other.

4. An internal combustion engine according to claim 1, characterized in that each intake port (4) and/or exhaust port (5) is equipped with at least one movable seat (6, 7) which makes it possible to modify the section for the passage of fluids, and the moment or instant at which said orifice opens or closes, which movable seats (6, 7) are housed inside the cavities which constitute the intake manifolds (31) and exhaust manifolds (32).

5. An internal combustion engine according to claim 4, characterized in that each intake port (4) and/or exhaust port (5) is equipped with two movable seats (6, 7) mounted so that they can move close together or apart, which movable seats (6, 7) are housed inside the cavities which constitute the intake manifolds (31) and exhaust manifolds (32).

6. An internal combustion engine according to claim 1, characterized in that one end of the rotary valves (8, T-8; 9, T-9) is equipped with a driving end piece (12) and in that the end part (26*a*) of this end piece is designed or shaped to ensure the driving of a device necessary to the operation of the engine.

7. An internal combustion engine according to claim 1, characterized in that one end of the rotary valves (8, T-8; 9, T-9) is equipped with an end piece (14) which includes a tubular axial extension (14*a*) for connecting to a carbureted mixture intake pipe or to an exhaust pipe.

8. An internal combustion engine according claim 1, whose the rotary valves (8, T-8; 9, T-9) are guided in rotation by means of bearings or rings (16*a*, 16*b*, 16*c*), characterized in that these bearings or rings are surrounded by two eccentric and concentric rings (17, 18), at least one of which can be driven in a rotation of limited amplitude.

9. An internal combustion engine according to claim 4, characterized in that the seats (6, 7) of the rotary valves (8, T-8; 9, T-9) curve inward and are guided in lateral flanges (52).

10. An internal combustion engine according to claim 4, characterized in that it includes means for adjusting the position of the movable seats (6, 7) of the rotary valves (8, T-8; 9, T-9).

11. An internal combustion engine according to claim 10, characterized in that the device for adjusting the position of the movable seats (6, 7) of the rotary valves (8, 9) comprises a cylinder (36) which is impermeably installed through the impermeable wall (34) separating the intake manifold (31) and the exhaust manifold (32), and in which is housed a piston (42) subject to the action of a compression spring (47) which tends to push it in the direction of the exhaust manifold (32), at least one side of which piston (42) is linked by means of a joint (41) to a control rod (40*a*, 40*b*) which is itself linked to a connecting rod (44) attached to a shaft (45) to which are also attached connecting rods (59), each of which is linked by means of a transmission linkage (51) to at least one of the movable seats (6, 7) of at least one of the rotary valves (8, T-8; 9, T-9).

12. An internal combustion engine according to claim 11, characterized in that each of the opposite sides of the piston (42) is connected, by means of a rod (40*a*, 40*b*), and by means of a transmission (44, 45, 59) and a linkage (51) to at least one of the movable seats (6, 7) of each rotary valve (8, T-8; 9, T-9).

* * * * *